US005285859A

United States Patent [19]

Tibbitts

[11] Patent Number: 5,285,859

[45] Date of Patent: Feb. 15, 1994

[54] DRILL BIT CUTTER MOUNTING SYSTEM PROVIDING SELECTABLE ORIENTATION OF THE CUTTING ELEMENT

[75] Inventor: Gordon A. Tibbitts, Salt Lake City, Utah

[73] Assignee: Baker Hughes Incorporated, Houston, Tex.

[21] Appl. No.: 17,148

[22] Filed: Feb. 12, 1993

[51] Int. Cl.[5] ..... E21B 10/00

[52] U.S. Cl. ..... 175/57; 175/428

[58] Field of Search ..... 175/57, 412, 413, 420.1, 175/426, 428, 431

[56] References Cited

U.S. PATENT DOCUMENTS 4,373,410 2/1983 Davis ..... 175/428 X
4,505,342 3/1985 Barr et al. ..... 175/428
4,877,096 10/1989 Tibbitts .
4,956,238 9/1990 Griffin ..... 175/428 X
4,981,184 1/1991 Knowlton et al. .
4,989,578 2/1991 Lebourg .
4,991,670 2/1991 Fuller et al. .
5,025,874 6/1991 Barr et al. .

*Primary Examiner*—Thuy M. Bui
*Attorney, Agent, or Firm*—Trask, Britt & Rossa

[57] ABSTRACT

Drill bit cutter structure and means of mounting said cutter structure relative to a drill bit for drilling earth formations is described in which the cutter structure provides diverse rotational orientation of the cutting element about at least one axis relative to the drill bit. The cutter structure generally includes a bearing surface associated with the drill bit, a supporting member articulable with the bearing surface to provide diverse orientation thereof, and a cutting element secured to said supporting member.

18 Claims, 3 Drawing Sheets

DRILL BIT CUTTER MOUNTING SYSTEM PROVIDING SELECTABLE ORIENTATION OF THE CUTTING ELEMENT

BACKGROUND

1. Field of the Invention

This invention relates to drill bits used in earth formation coring and drilling. Specifically, this invention relates to a drill bit cutter structure and mounting system which provides for selectable orientation of the cutting element relative to the formation.

2. State of the Art

Numerous types and configurations of drill bits are used for drilling and coring of earth formations. The design of a drill bit used in any particular application is generally dictated by the type of formation or type of drilling which is to be done. Further, the type of drilling dictates the type of cutting element which is used in association with the drill bit.

A commonly used drill bit, termed a rotary drag bit, is one which includes stationary cutters, secured to the face or profile of the drill bit. Such stationary cutters typically comprise a substantial planar, synthetic diamond cutting element attached to a carrier, sometimes referred to as a cylinder or stud, by means of a backing or supporting layer or substrate. Non-planar cutting elements, such as convex, concave, "dome" shaped, as well as polyhedral natural and synthetic diamonds are also employed, however, with various configurations of carriers. The cutting element includes a diamond layer or surface secured during manufacture of the cutting element to a supporting layer or substrate, which is in turn secured to the cylinder, or stud or otherwise configured carrier. The diamond layer may have a chamfered or rounded cutting edge, as employed in the art to minimize cutter damage during the initial portion of the drilling operation before the cutter is worn significantly. Both the supporting layer and carrier are usually made of a hard material such as tungsten carbide.

In drill bits of the type described, a plurality of carriers are embedded in the face of the drill bit in preformed openings sized to receive the carriers. Alternatively, the carrier may be embedded in the drill bit face during formation of the bit body of a matrix-body drill bit, as widely employed in the art. This technique is particularly common with cylindrical carriers. The particular position which each carrier assumes when inserted or otherwise fixed in the drill bit face determines the angle of cut which will be achieved by the cutting element's diamond layer on the formation being drilled. That is, the side rake, which may be used to refer to the angle of rotation the cutting element relative an axis parallel to the longitudinal axis of the drill bit in relation to a radial line extending through the cutter, and the back rake, which may be used to refer to the angle of the cutting element relative to the vertical axis of the drill bit, are determined by the fixed orientation of the carrier in the drill bit face. It should be noted in passing that the term "back rake" is a term of art and may be a misnomer in certain instances, such as when a cutting surface is forwardly, or "positively" raked, rather than backwardly, or "negatively" raked or inclined. Therefore, as used herein the term "back rake" may refer to either a negative or positive incline of the cutting surface. Similarly, in drill bits which do not employ carriers, cutters may be embedded in the drill bit face in preformed openings, the angle of which determine the rakes or orientation of the cutter.

The characteristics of the formation to be drilled are in large part determinative of the necessary side rake and back rake of the cutters. For example, tougher formations may require a drill bit having cutters with a more negative back rake to prevent cutter damage. A softer formation permits a more positive rake, but not too positive or aggressive as the bit may then stall. Stated another way, the degree of cutter backrake may be used to control torque experienced by the bit and the cutters. Therefore, the characteristics of the formation are assessed prior to drilling and a drill bit is designed with preformed openings drilled or otherwise formed in desired locations in the bit face at angles corresponding to the desired angles that the cutting elements should assume to produce the desired cuts.

The limited ability to adjust the carriers or cutters embedded in the drill bit of prior art systems necessarily limits the amount of positioning or adjustment which can be attained to accurately establish a desired cutting angle with respect to side rake and back rake. The number of cutters which can be placed for desired effect is also severely limited, as the carrier elements tend to mutually interfere, preventing many otherwise desirable cutter groupings. Thus, it would be advantageous to provide a cutter structure and system for mounting the cutter which provides variable location and orientation of the cutting element relative to, but independent of, the orientation of the carrier or the drill bit.

SUMMARY OF THE INVENTION

In accordance with the present invention, cutter structure and a system for mounting the cutter provide modifiable orientation of the cutting element relative to the drill bit to enable accurate adjustment of the cutting element side rake and back rake substantially independent of the location or orientation of a cutting element carrier in the drill bit face, or of the location or orientation of a pocket or socket in the drill bit face in which the cutting element is directly inserted.

According to the invention, a cutter is structured to be adjustably orientable relative to a bearing surface on a carrier or drill bit to which the cutter is thereafter secured. That is, the cutter orientation may be adjusted relative to the bearing surface until a particular rakes or angles of the cutter is achieved, and then the cutter secured to the bearing surface. The cutter is structured to permit adjustment of the cutter in a plurality of directions with respect to the bearing surface.

The cutter of the present invention may be comprised of a cutting element secured to a supporting member. The cutting element may be formed of any suitable material, such as natural or synthetic diamond, the latter secured during fabrication to a supporting layer or substrate of hard material such as cemented or sintered WC. The supporting member is preferably formed of a sturdy material, such as WC or other hard metal. The cutting element is secured to the supporting member by suitable means known in the art including brazing, adhesive bonding or welding.

The cutter is, in turn, secured to a bearing surface via the supporting member. The bearing surface may be on a carrier such as a cylinder or stud which has been previously embedded in a preformed opening in the outer surface of a drill bit. Alternatively, the bearing surface may comprise a preformed or machined portion of the outer surface of the drill bit. The cutter supporting member is secured to the bearing surface in any suitable manner, including brazing, welding or adhesive bonding.

In accordance with the invention, the cutter is adjustable relative to the bearing surface to achieve a desired side rake and/or back rake. The angle of inclination of the cutting surface of the cutting element, relative to the longitudinal axis of the drill bit, is determinative of the positive or negative back rake. Further, the radial position of the cutter, relative to the central axis of the drill bit, in combination with the rate of penetration and rotational speed of the drill bit, is determinative of the effective back rake angle. Side rake is determined by the rotational orientation of the cutting surface about an axis parallel to the longitudinal bit axis relative to a radial line extending through the cutter.

Typically, cutters associated with a drill bit are positioned about the outer surface of the drill bit to maximize the cutting action of the cutters on the formation. Therefore, the cutters may be staggered about the drill bit to produce various fully or partially overlapping circular cutting paths. The direction of side rake and back rake of each cutter may be different from the direction of rake of adjacent cutters.

The variability of cutter direction or orientation of the present invention is obtainable by determining (such as by mathematical modeling) the necessary orientation of the cutting element in accordance with the relevant formation parameters, orienting the cutter relative to the bearing surface, and securing the cutter in place. The present invention has the added advantage of permitting removal and repositioning of the cutters following a drilling operation to reposition the cutters as required by changes in the formation characteristics, to replace worn or damaged cutters, or both.

BRIEF DESCRIPTION OF THE ILLUSTRATED EMBODIMENTS

In the drawings, which illustrate what is currently considered to be the best mode for carrying out the invention, FIG. 1 is a view in transverse cross section of a drill bit in which is embedded a number of carriers each having a cutter mounted thereto in accordance with the invention;

DETAILED DESCRIPTION OF THE ILLUSTRATED EMBODIMENTS

Figure 1:
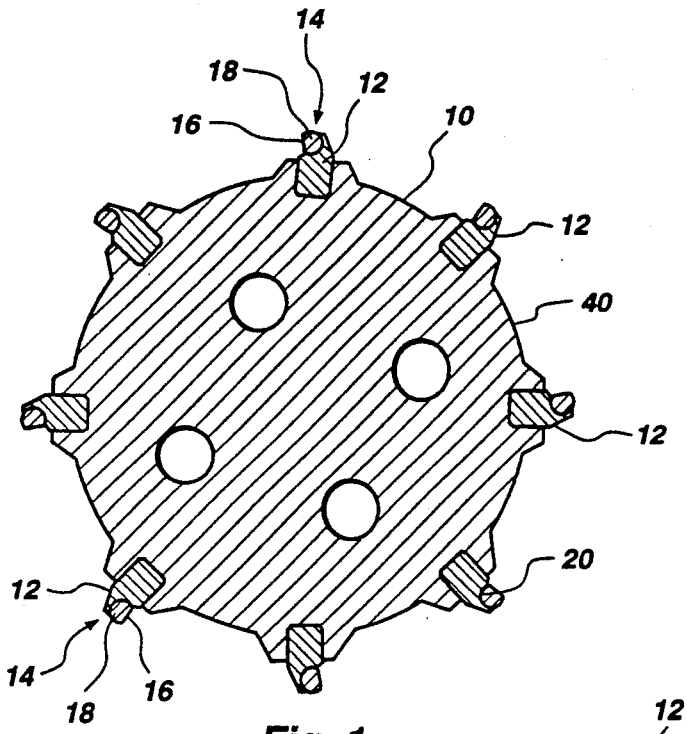

FIG. 1 generally illustrates an exemplary assemblage of a bit employing the cutter mounting system of the invention wherein a drill bit 10, shown in lateral cross section, has a plurality of carriers 12 embedded in the circumference of the bit face thereof. Each carrier 12 (shown as studs by way of example) provides a bearing surface 20 to which a cutter 14 is attached. Each cutter 14 is comprised of a cutting element 16 having a cutting surface 32 attached to supporting member 18. The drill bit 10 illustrated in FIG. 1 is only representative of the entire assemblage and is not suggestive of required structure or relative positioning of the cutters. The invention may practiced with any kind or configuration of drill bit, including drill bits for coring as well as drilling.

Figure 2:
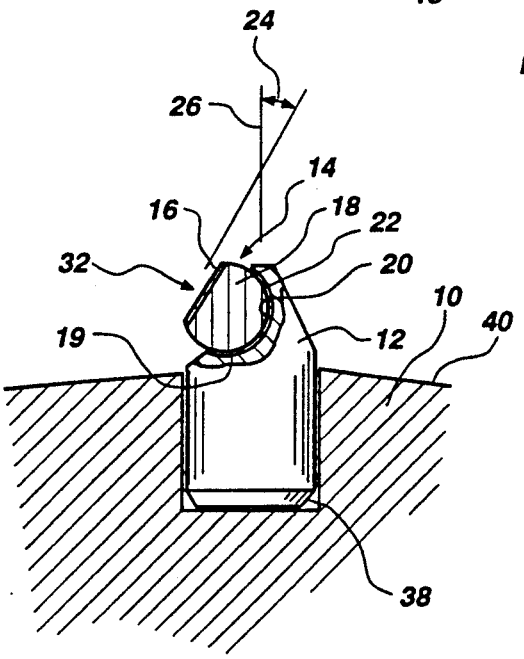
FIG. 2 is a partial cross sectional side view through a drill bit showing a stud-mounted cutter having a negative back rake orientation.

FIG. 2 more clearly illustrates the placement of the cutter 14 with respect to the bearing surface 20, here shown as an arcuate recess in cylindrical carrier 12, and the position of the cutting element 16 relative to the supporting member 18. The supporting member 18 may take any configuration or shape which provides a cooperating surface 19 for attachment of a cutting element 16 to bearing surface 20 and which provides for adjustment of the cutter 14 in a plurality of orientations relative to the bearing surface 20.

The supporting member 18 preferably may be formed from an appropriately hard material such as solid or cemented or sintered tungsten carbide or other suitable material. The shape of the supporting member 18 may be formed by any means appropriate to the material of which the supporting member is formed, or to the application, including milling, grinding, extrusion or molding.

The cutting element 16 is attached to a surface of the supporting member 18 in a manner to position the cutting element 16 for effective interaction with the formation. The cutting element 16 may be formed in any configuration which presents an appropriate cutting surface for the particular formation. As shown by FIG. 2, a particularly suitable cutting element 16 may include a planar cutting surface 32 in the form of a disk or circle. Alternatively, the cutting surface 32 of cutting element 16 may be planar and half-round to save material, or may even comprise a smaller segment of a circle such as a quarter-round element having one arcuate and two straight edges. Convex, concave, dome-shaped, polyhedral or other cutting surface configurations are also contemplated as benefitting from the present invention and having utility therewith. The cutting surface 32 of cutting element 16 may be formed from any suitable material such as PDC (polycrystalline diamond compact), TSP (thermally stable diamond product), natural diamond, diamond film, or combinations thereof. Other materials such as tungsten carbide, silicon nitride or cubic boron nitride may also be employed. The cutting element 16 is secured to the supporting member 18 by any appropriate means, including brazing, welding or adhesive bonding. It is contemplated that the cutting element 16 may comprise a substrate having a diamond table or layer thereon as is known in previously described prior art PDC structures. Alternatively, the cutting element 16 may comprise a diamond layer, such as a diamond film, directly deposited on supporting member 18, in which instance the "bonding" of the cutting element 16 to supporting member 18 is effected simultaneously with the formation of the former.

The supporting member 18 is articulable with the bearing surface or carrier 12 to facilitate orientational adjustment of the cutter 14 "articulable" as used herein meaning rotationally orientable about at least one axis. A particularly suitable means for accomplishing maximum articulation between the supporting member 18 and the bearing surface 20 is illustrated in FIGS. 1–4 where the ball-shaped cooperating surface 19 of cutter 14 fits within socket-shaped bearing surface 20 of carrier 12, thus providing articulation capability about x, y and z axes, a particularly beneficial feature when nonsymmetrical cutting surfaces or non-homogeneous cutting are employed. A rounded socket 20 is particularly suitable because it provides greater shear strength to the cutter 14. However, other configurations of the bearing surface such as a partial cylinder may also provide increased shear strength. Once the cutter 14 has been adjusted to its proper angular orientation it is secured to carrier 12 by an appropriate means, such as bonding, brazing, welding or sintering, as represented at 22.

It is desirable to position the cutting surfaces 32 of cutters 14 at a particular inclination relative to the formation being drilled to effect a desired pattern and type of cut within the formation. For example, tough formations may be more successfully cut when the cutting element 16 is inclined or raked at a backward angle with respect to the drill bit axis, while plastic formations may respond to more positive or aggressive cutting surface orientations.

Figure 4:
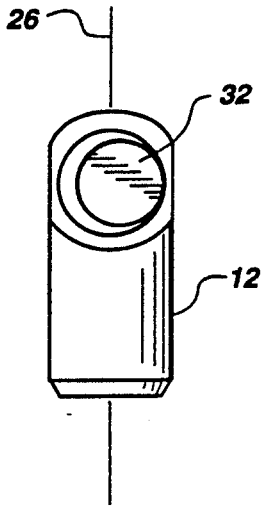
FIG. 4 is an front elevation view of the stud-mounted cutter of the type shown in FIG. 2, the cutter being oriented with a side rake
Figure 4A:
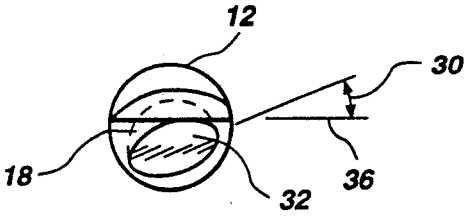
FIG. 4A is a top elevation of the cutter of FIG. 4.
Figure 3:
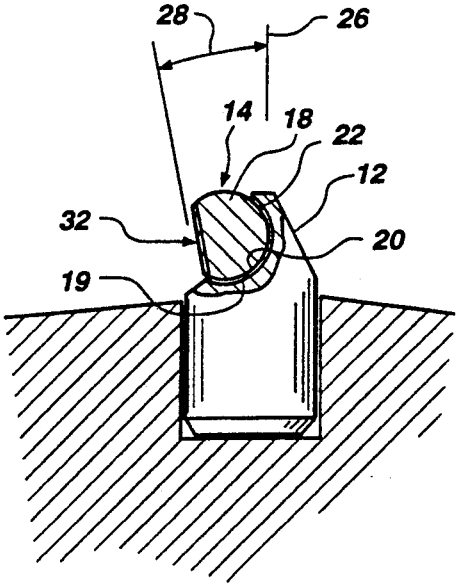
FIG. 3 is a partial cross sectional side view through a drill bit showing a stud-mounted cutter having a positive back rake orientation.

FIG. 2 illustrates cutting surface 32 of cutting element 16 being rearwardly inclined at an angle 24 to a vertical axis 26 of the carrier 12, vertical axis 26 (for illustrative purposes and not by way of limitation) being parallel to the longitudinal axis of drill bit 10. This may be termed a negative back rake. As illustrated in FIG. 3, the cutter 14 may be positioned to forwardly incline cutting surface 32 at an angle 28 to the vertical axis 26 of the carrier. That inclination is referred to as a positive back rake. The degree of desired negative or positive inclination of the rake is determined by the particular characteristics of the formation, position of the cutter on the bit face, anticipated rotational speed of the bit, and rate of penetration. Further, as shown in FIGS. 4 and 4A, the angle 30 of rotation of the cutting surface 32 relative to the vertical axis 26 of the carrier 12 in comparison to redial line 36 extending from the center to the gage of the drill bit 10 through the cutter may be referred to as the side rake. Thus, it can be seen that virtually an infinite multitude of positions, providing various angles of inclination of the cutting surface 32, is achievable by the present invention.

Although the degree of back rake or side rake described immediately above is in reference to the vertical axis of the carrier 12 (and of bit 10), it should be realized that the actual angle of inclination of the cutting surface 32 of the cutter 14 is determinable in relation to the formation. Therefore, in order to properly locate and orient the cutters 14 and the cutting surface 32 thereof, it is desirable to assess the characteristics of the formation and to estimate performance characteristics of the drill bit 10.

It is important to understand that the drill bit rotating in a formation does not move in a stationary horizontal plane. Rather, the drill bit moves downwardly through the formation to effect a downwardly spiralling path. Thus, the effective path followed by a cutter 14 associated with the drill bit 10 is generally downward at an angle of inclination related to the drilling rate or rate of penetration of the drill bit 10. For example, a drill bit 10 having a cutter 14 rotating in a radius of six inches from the center of the drill bit, at a drilling rate of ten feet per minute, and at a rotational speed of fifty revolutions per minute results in a spiralling path having an angle of inclination relative to the horizontal plane of the bottom of the bore hole of approximately four degrees. If the cutting surface 32 of the cutter 14 has an apparent angle of inclination relative to the horizontal of approximately 86° (40 negative rake, relative to horizontal), then the cutting surface has an effective angle of inclination, or effective rake, of precisely 90° and will be neither negatively nor positively raked. A rake as described is termed a "neutral" rake angle.

The radial position of the cutter 14 relative to the center of the drill bit 10 is determinative as to the effective rake angle. For example, if the cutter 14 is positioned on the surface of the drill bit 10 at a radial distance of only three inches from the center, then its path (given the drilling parameters set forth above) has an angle of inclination relative to the horizontal plane of the bore hole of approximately seven degrees. The closer a cutter is positioned to the bit center, the greater the angle of inclination relative to the horizontal plane of the bore hole for a given rotational speed and given actual rake, and the greater the apparent negative rake of the cutter must be to obtain an effective negative rake angle.

Applying the principles outlined immediately above, the angle of inclination can be determined for each cutter 14 associated with the drill bit. Thus, each cutter 14 may be adjusted within the socket 20 of the carrier 12 to position the cutting surface 32 at precisely the correct angle to effect the most appropriate cut. After being positioned at the proper angle, the cutter 14 is then secured into place.

The cutter 14 may be secured to any appropriate bearing surface to carry out the principles of the invention. FIGS. 1–4 illustrate one embodiment where the bearing surface for the cutter 14 is a cylindrical stud-type carrier 12. Further, in this embodiment, the carrier 12 is positioned in a preformed opening 38 in the drill bit 10. The carrier 12 is then secured into the opening 38 by an appropriate means, such as welding, brazing, adhesive bonding, shrink fit or press fit.

Figure 5:
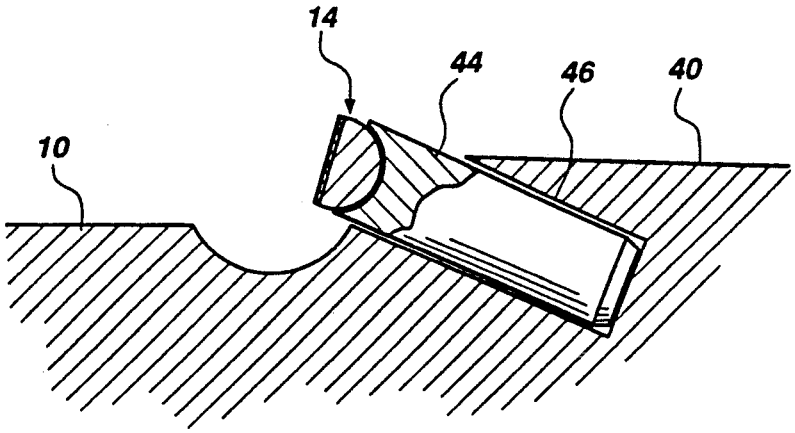
FIG. 5 is an elevational view, in partial cutaway, of a cutter mounted in an angled carrier or elongated stud.
Figure 6:
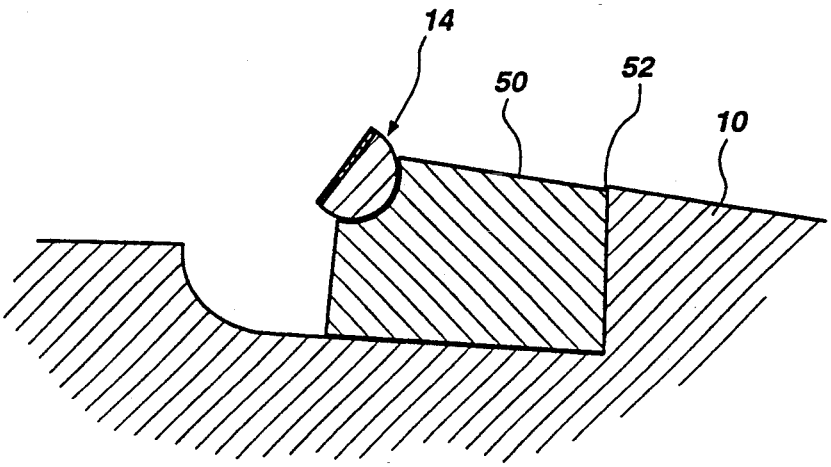
FIG. 6 is a view in cross-section of a cutter mounted in a rectangular carrier.

As illustrated by FIG. 5, the cutter 14 may also be secured to an elongated cylindrical carrier 44 which is embedded in a preformed opening 46 of the drill bit 10 at a shallow angle to the outer surface 40 of the drill bit 10. In yet another embodiment, shown in FIG. 6, the cutter 14 may be secured to a carrier 50 having a rectangular or square shape. The carrier 50 in this embodiment is buttressed by a shoulder 52 formed in the drill bit 10 to provide a strong support for the carrier 50.

Figure 7:
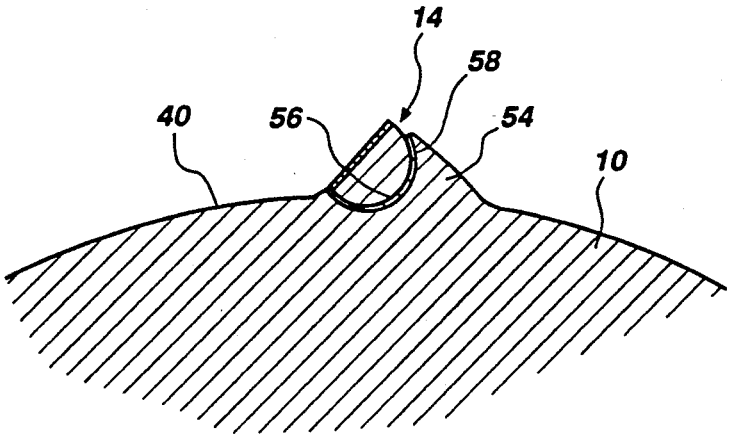
FIG. 7 is a view in cross-section of a cutter secured directly to the drill bit face.

In an alternative embodiment, the drill bit 10 itself may serve as the bearing surface for the cutter 14 as illustrated in FIG. 7. Preferably, the drill bit 10 is structured with a stabilizing projection 54 which extends outwardly from the outer surface 40 of the drill bit 10. The stabilizing projection 54 is structured to provide a bearing surface 56 for the cutter 14 and permits diverse orientations of the cutter 14 to produce any desired rake angle therein. Bearing surface 56 may reside in the material of the bit body, or may be an insert (such as a cup-shaped insert) of a different material which is cast, sintered or infiltrated in place during manufacture of the bit. The cutter 14, once positioned at the desired angle, is then secured in place against the bearing surface 56 of the stabilizing projection 54 by any appropriate means such as brazing 58.

Figure 8:
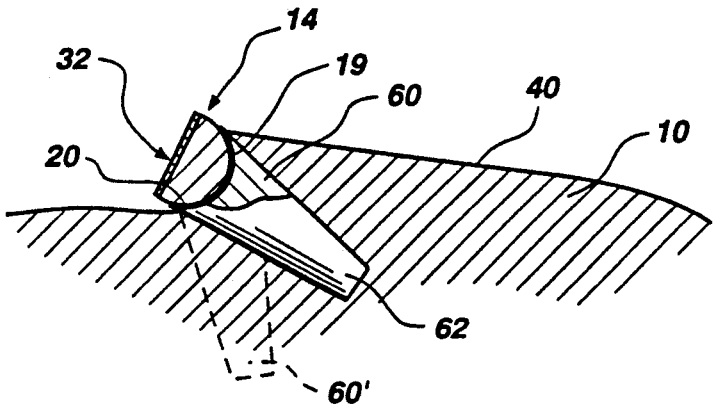
FIG. 8 is a partial cross-sectional side elevation of a cutter mounted in a tapered carrier.
Figure 10:
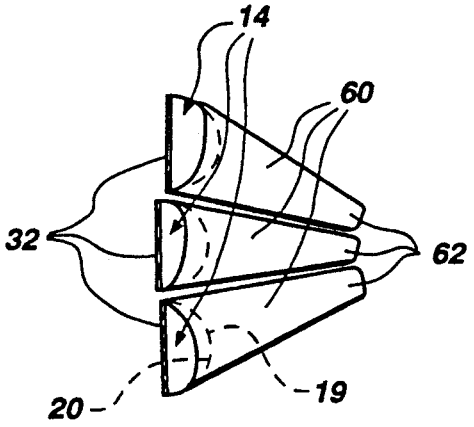
FIG. 10 is a top elevation of a plurality of grouped, closely-adjacent tapered carriers.

FIG. 8 illustrates an embodiment of the present invention employing tapered, conically-configured carrier 60. As shown at 60', a plurality of such tapered carriers may be employed in side-by-side relationship, and in the same or differing vertical orientations. Moreover, the tapered trailing ends 62 of carriers 60 permit closer packing of adjacent carriers 60 in the same vertical orientation (see FIG. 10), particularly on smaller diameter bits, while the bearing surfaces 20 and cooperating surfaces 19 facilitate precise and similar orientations of adjacent cutting surfaces 32. Of course, tapered elements 60 need not be of circular cross section, if another is desired.

Figure 9:
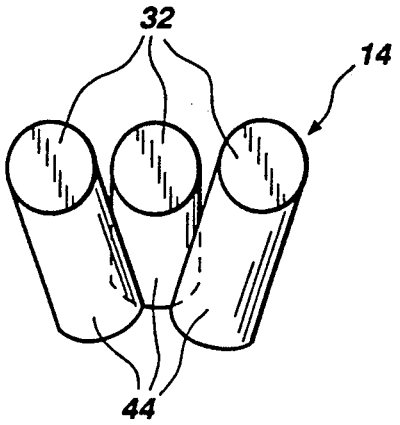
FIGS. 9 and 9A illustrate a plurality of closely-grouped elongated cutter-bearing carriers of differing vertical orientations.
Figure 9A:
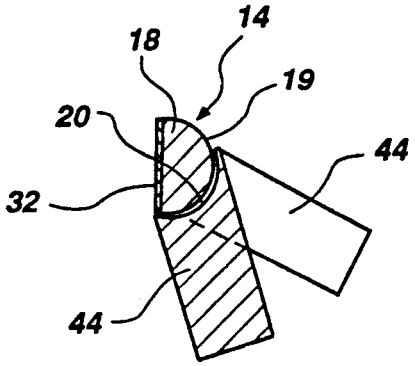

FIGS. 9 and 9A depict use of a plurality of elongated cylindrical carriers 44 as previously described with respect to FIG. 5. As shown, because of the present invention, the angles of adjacent carriers 44 in the drill bit body may be varied to permit close packing of cutters 14 on the drill bit crown while cutting surfaces 32 may be fixed in substantially identical (or other desired) orientation.

Figure 11:
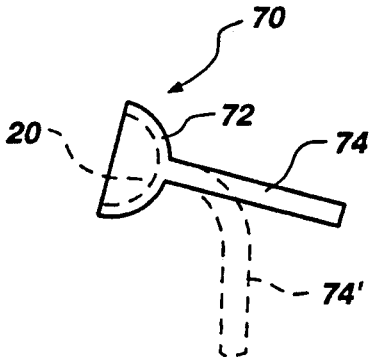
FIG. 11 is a side elevation of a carrier for use in the present invention having a cup-shaped leading segment and a rod-shaped trailing segment.

FIG. 11 illustrates a carrier element 70 according to the present invention including a cup-shaped leading segment 72 having bearing surface 20, and a rod-shaped trailing segment 74, which may extend straight back from leading segment 72 or curve downwardly, as shown at 74'.

The structure of the cutter and bearing surface, and the method of securing the cutter to the bearing surface in the present invention, permit the removal of the cutters from the bearing surface and repositioning of the cutters. That is, while the assessed characteristics of a certain formation may indicate that the cutters should be positioned with a particular rake or angle, actual drilling may show that the cutters need to be positioned differently than first expected. With the present invention, the drill bit may be removed from the hole, the cutters removed from the bearing surfaces, reoriented, and re-secured for more effective cutting. This is in contrast to prior art drill bits which have embedded carriers, and preset cutters of fixed orientation, which require substitution or replacement of the drill bit (or at the least removal and replacement of entire cutter assemblies, including carriers) if the cutting surface of the cutters are not oriented correctly. Further, with the present invention, one or more cutters may be removed when worn, rotated to present unworn, fresh portion of their cutting surfaces, and resecured to bearing surfaces. Finally, the present invention facilitates replacement of damaged cutters.

The present invention is directed to providing adjustable and repositionable cutters relative to but independent of a bearing surface associated with a drill bit to readily achieve a desired cutting angle on an earth formation. The concept may be adapted to virtually any type or configuration of drill bit or cutting element, and may be adapted for any type of drilling or coring operation. The structure of the invention may be modified to meet the demands of the particular application. For example, if adjustment or articulation about only a single axis is desired, a bearing surface and supporting member may be cooperatively configured, such as in a half-cylindrical configuration, to permit only such motion and constrain all others. Thus, side rake could be fixed, and only back rake adjustable, or vice versa. Additionally, the ball and socket type of cooperating surfaces in the cutter supporting member and bearing surface associated with the bit may be reversed, so that the bearing surface is hemispherical or even ball-shaped, and the supporting member has a cooperating concave surface. A combination carrier for receiving two or more cutters 14 is also clearly contemplated. Hence, reference herein to specific details of the illustrated embodiments is by way of example and not by way of limitation. It will be apparent to those skilled in the art that many additions, deletions and modifications to the illustrated embodiments of the invention may be made without departing from the spirit and scope of the invention as defined by the following claims.

What is claimed is:

1. Cutting structure associated with a drill bit for use in drilling earth formations comprising:

a bearing surface associated with said drill bit;

a supporting member structured to articulate with respect to said bearing surface to provide diverse rotational orientation, about at least one axis, of said supporting member relative to said bearing surface, said supporting member being securable to said bearing surface at a desired orientation; and a cutting element securable to said supporting member.

2. The cutting structure of claim 1, wherein said supporting member includes a substantially hemispherically-shaped portion and a flat surface and said bearing surface is configured as a rounded socket sized to receive said substantially hemispherical portion of said supporting member thereagainst.

3. The cutting structure of claim 2, wherein said cutting element is at least a segment of a disk adapted to be secured to said flat surface of said supporting member.

4. The cutting structure of claim 3, wherein said disk segment is circular.

5. The cutting structure of claim 3, wherein said disk segment is semicircular having a straight edge and an arcuate edge, said arcuate edge being oriented relative to said supporting member so that said arcuate edge is positioned to contact said earth formations during said drilling.

6. The cutting structure of claim 1, further including a carrier supported by said drill bit, said bearing surface being associated with said carrier.

7. The cutting structure of claim 1, wherein said bearing surface is associated with the outer surface of said drill bit and is structured to retain said supporting member thereagainst.

8. A drill bit for drilling an earth formation comprising:

a drill bit body having an outer surface oriented toward said earth formation;

a plurality of bearing surfaces associated with said drill bit body;

a supporting member positionable against each said bearing surface and structured to articulate relative thereto to provide diverse rotational orientation of said supporting member about at least one axis relative to said drill bit body; and a cutting element securable to each said supporting member.

9. The drill bit of claim 8, wherein each said supporting member includes a substantially hemispherical portion and a flat surface and wherein each said bearing surface is configured as a rounded socket against which said substantially hemispherical portion of said supporting member is positionable.

10. The drill bit of claim 9, wherein each said cutting element is at least a segment of a disk positionable adjacent said flat surface of each said supporting member.

11. The drill bit of claim 10, wherein said disk segment is circular.

12. The drill bit of claim 10, wherein said disk segment is semicircular having a straight edge and an arcuate edge, said arcuate edge being oriented relative to said supporting member so that said arcuate edge is positioned to contact said earth formation during said drilling.

13. The drill bit of claim 8 further including a plurality of carriers supported by said drill bit body and oriented to project outwardly from said drill bit body, a said bearing surface being associated with each of said carriers.

14. The drill bit of claim 8, wherein said bearing surfaces are formed in said outer surface of said drill bit body.

15. A method of drilling an earth formation comprising:

providing a drill bit connectable to a drill string, said drill bit having associated therewith a plurality of cutters each comprising;

a bearing surface associated with said drill bit;

a supporting member articulable with said bearing surface to provide diverse rotational orientation of said supporting member about at least one axis; and a cutting element associated with said supporting member;

determining the desired angle of said cutting element to effect a desired cut in said formation;

adjusting said supporting member relative to said bearing surface to achieve said desired angle of said cutting element; and securing said supporting member against said bearing surface.

16. The method of drilling according to claim 15 further comprising:

placing said drill bit downhole;

drilling said formation;

removing said drill bit from downhole;

removing a said supporting member from its corresponding bearing surface of at least one of said cutters;

repositioning said removed supporting member relative to said bearing surface to produce a different angle for said cutting element with respect thereto; and securing said repositioned supporting member to said bearing surface.

17. The method of drilling according to claim 16, wherein said repositioning comprises rotation of said removed supporting member so as to present an unworn portion of said cutting element to contact said formation.

18. The method of drilling according to claim 15, further comprising:

placing said drill bit downhole;

drilling said formation;

removing said bit from downhole;

removing a said supporting member from its corresponding bearing surface of at least one of said cutters; and replacing said supporting member with a different supporting member carrying another cutting element.

* * * * *

UNITED STATES PATENT AND TRADEMARK OFFICE

CERTIFICATE OF CORRECTION

PATENT NO. : 5,285,859

DATED : 2/15/94

INVENTOR(S) : Gordon A. Tibbitts

It is certified that error appears in the above-identified patent and that said Letters Patent is hereby corrected as shown below:

Title page, item [57], col. 2, line 3,
In the Abstract, line 3, change "is" to --are--;

In Column 1, line 24, change "substantial" to --substantially--;

In Column 2, line 1, change "determine" to --determines--;

In Column 2, line 10, change "backrake" to --back rake--;

In Column 2, line 47, after "until" delete "a";

In Column 2, line 48, change "is" to --are--;

In Column 3, line 55, change "an" to --a--;

In Column 3, line 58, delete the period after "4";

In Column 4, line 22, after "may" insert --be--;

In Column 5, line 20, after "ting" insert --surfaces--;

In Column 5, line 53, change "redial" to --radial--;

In Column 6, line 17, change "(40" to --(4°--; and

In Column 9, line 32, after "comprising" change the semicolon to a colon.

Signed and Sealed this

Thirtieth Day of August, 1994

*Attest:*

*Attesting Officer*

Bruce Lehman

BRUCE LEHMAN

*Commissioner of Patents and Trademarks*